US006901979B1

(12) United States Patent
Herold

(10) Patent No.: US 6,901,979 B1
(45) Date of Patent: Jun. 7, 2005

(54) TRAVEL BAG HAVING RESTRAINT DEVICE FOR GOLF CLUB SETS

(76) Inventor: Jeffrey C. Herold, 18261 Enterprise La., Suite A, Huntington Beach, CA (US) 92648

( * ) Notice: Subject to any disclaimer, the term of this patent is extended or adjusted under 35 U.S.C. 154(b) by 0 days.

(21) Appl. No.: 10/678,984

(22) Filed: Oct. 2, 2003

Related U.S. Application Data

(63) Continuation of application No. 08/734,253, filed on Oct. 21, 1996, now abandoned.

(51) Int. Cl.[7] ..... A63B 57/00
(52) U.S. Cl. ..... 150/159; 206/315.4
(58) Field of Search ..... 159/159, 160; 206/315.3, 315.4; 150/154; 190/26

(56) References Cited

U.S. PATENT DOCUMENTS

| | | | | |
|---|---|---|---|---|
| 1,119,508 | A * | 12/1914 | Headley | 206/315.4 |
| 1,325,692 | A | 12/1919 | Cross | |
| 1,442,906 | A * | 1/1923 | Rawlings et al. | 206/315.4 |
| 1,555,772 | A | 9/1925 | Stripe | |
| 1,798,638 | A * | 3/1931 | Stone et al. | 206/315.6 |
| 1,859,970 | A | 5/1932 | Kaufmann | |
| 2,466,160 | A | 4/1949 | Deorrlamm | |
| 2,602,676 | A | 7/1952 | Fieldhouse | |
| 2,718,251 | A | 9/1955 | Barbato | |
| 2,868,559 | A | 1/1959 | Vincelette | |
| 3,125,854 | A | 3/1964 | Skowron, Sr. | |
| 3,128,854 | A | 4/1964 | Specht | |
| 3,158,299 | A | 11/1964 | Wier et al. | |
| 3,316,951 | A | 5/1967 | Jacobson | |
| 3,418,005 | A | 12/1968 | Allina | |
| 3,471,163 | A | 10/1969 | Swara | |
| 3,693,849 | A | 9/1972 | Knabenbauer | |
| 3,985,171 | A | 10/1976 | Summers et al. | |
| 3,998,304 | A | 12/1976 | Edgerton, Jr. et al. | |
| 4,059,464 | A | 11/1977 | Geller et al. | |
| 4,174,747 | A * | 11/1979 | Boles | 206/315.6 |
| 4,301,849 | A | 11/1981 | Litwack et al. | |
| 4,402,355 | A * | 9/1983 | Wymore et al. | 206/315.1 |
| D280,362 | S | 9/1985 | Allen | |
| 4,596,397 | A | 6/1986 | Conti | |
| 4,657,135 | A | 4/1987 | Kjose | |
| 4,729,460 | A | 3/1988 | Kim | |
| 4,752,004 | A | 6/1988 | Very | |
| D296,955 | S | 8/1988 | Janney et al. | |

(Continued)

FOREIGN PATENT DOCUMENTS

| | | |
|---|---|---|
| DE | 2400956 | 7/1985 |

(Continued)

*Primary Examiner*—Sue A. Weaver
(74) *Attorney, Agent, or Firm*—Thelen Reid & Priest, LLP

(57) ABSTRACT

A golf club travel bag is provided with a mechanism to restrain the movement of golf clubs contained therein. The bag is comprised of a rugged material which forms a cavity having an opening operated by a zipper. The top of the bag is supplemented with a special protective layer affixed to the interior surface. The protective layer may be a foam material operable for absorbing shock. A strap is arranged in a looping fashion symmetric about the longitudinal axis of the bag. A fastened strap applies a inward radial force onto the protective layer and further to clubs stored in the bag thereby holding the clubs from moving and causing damage to each other.

11 Claims, 5 Drawing Sheets

U.S. PATENT DOCUMENTS 4,792,152 A 12/1988 Carolan
4,905,827 A 3/1990 Kim
4,911,465 A 3/1990 Haur
4,934,573 A 6/1990 Jaeger
4,953,768 A 9/1990 Muse
5,033,759 A 7/1991 Wix
5,071,147 A 12/1991 Stansbury
5,105,919 A 4/1992 Bomes et al.
5,109,961 A 5/1992 Bergman
5,112,068 A 5/1992 Liao et al.
5,207,323 A * 5/1993 McConnell ..... 206/315.1
5,215,318 A 6/1993 Capraro
5,244,219 A 9/1993 Hadlum
5,265,894 A 11/1993 Dunn
5,289,906 A 3/1994 Guidi
5,295,565 A 3/1994 Latshaw
5,307,908 A 5/1994 Shyr et al.
D352,167 S * 11/1994 Sheppard, Jr. ..... D3/255
5,374,073 A 12/1994 Hung-Hsin
5,383,505 A 1/1995 Cordasco, Jr.
5,431,262 A 7/1995 Rekuc et al.
5,443,156 A 8/1995 Shioda
5,447,261 A 9/1995 Mitomi et al.
5,456,342 A 10/1995 Rekuc et al.
5,470,095 A 11/1995 Bridges
5,498,010 A 3/1996 Stube
5,515,897 A 5/1996 Fehan
5,524,737 A 6/1996 Wang
5,551,561 A * 9/1996 MacRae et al. ..... 206/315.3
5,575,362 A 11/1996 Franklin et al.
5,632,496 A 5/1997 Nelson
5,634,576 A 6/1997 Arbel
5,676,247 A * 10/1997 Shioda ..... 206/315.4
5,743,363 A 4/1998 Rekuc et al.
5,743,447 A 4/1998 McDerrmott
5,749,503 A 5/1998 Wulf et al.
6,068,271 A 5/2000 Lustica

FOREIGN PATENT DOCUMENTS

FR 2590458 5/1987
GB 101041 * 8/1916
JP 621 78 26 8/1994
JP 09028846 A * 2/1997 ..... A63B 55/00

* cited by examiner

TRAVEL BAG HAVING RESTRAINT DEVICE FOR GOLF CLUB SETS

CROSS-REFERENCE TO RELATED APPLICATION

This application is a continuation and claims priority based on parent application Ser. No. 08/734,253, entitled "Travel Bag Having Restraint Device For Golf Club Sets" by Jeffrey C. Herold, filed Oct. 21, 1996 now abandoned.

BACKGROUND OF THE INVENTION

Field

This invention is generally concerned with luggage and luggage accessories relating to restraining straps and specifically concerned with restraining straps on travel bags for golf club sets.

A set of golf clubs is carried about a golf course in a golf bag. The golf bag may be equipped with wheels to facilitate transport over turf from one hole to another. Special pockets may be provided to accommodate golf balls, tees and assorted related items. Although a golf bag as described is well suited for use on a golf course, it is not properly designed for general use and particularly for travel through airports, hotel lobbies and such. The opening in the top of the bag allows clubs to freely move and easily come free from containment in the bag. An improperly handled course bag may allow clubs to separate from the bag. For example, while loading the bag as cargo on an airplane, a course bag will not properly contain the clubs. Special tops have been devised which cooperate with a course bag to contain the clubs, however, the exterior of a course bag is subject to damage because its many straps and materials are not compatible with handling common to airports, taxi and other travel related environments.

A solution to this problem can be found in golf club travel bags. A golf club travel bag is designed to accommodate golf clubs, a golf club course bag, and additional equipment such as shoes, tees, gloves, et cetera. Accordingly, a golf club travel bag may designed to enclose the entire golf club set including the course bag. A travel bag is generally equipped with a zippered opening. A travel bag securely holds all golf equipment in a fully enclosed cavity. The bag may be made of a durable material which resists damage from friction and high impact forces which may be expected to be encountered in normal travel environments.

Kjose of Glendale, Calif. has invented a travel package for golf club sets which include a golf club course bag. The clubs are enclosed in a containment vessel and are prevented from coming free thereof. Additionally, Kjose teaches of a D-ring, a sack, and a drawstring all which cooperate together to further immobilize the clubs. Attention is drawn to lines 49–56 in column 6, of U.S. Pat. No. 4,657,135, where the reader will find a detailed description of this system. It is worthwhile to note that Kjose is concerned with restraining the clubs from movement, as this tends to reflect a long felt need in the field.

Another inventor, Mr. Dunn, has additionally taught similar features relating to his travel bag for golf club sets in U.S. Pat. No. 5,265,894. Mr. Dunn shows a travel bag having a course bag contained therein. The clubs are confined to a containment vessel which is zippered closed. The clubs are prevented from leaving the course bag or the travel bag.

As golf club heads may be formed of forged metallic materials, they tend to be very soft. If clubs are stored together such that they come into contact with each other, they may become damaged. Should a first club cause a sharp impact force on a second, the second club may be dented. For this reason, it is undesirable to store a golf club set in a travel bag without restraining the clubs from movement with respect to each other.

It is a well known practice to pack ones clubs for travel by using a towel. The towel may be wrapped between club heads to provide a cushion which insulates the clubs from impact forces. However, clubs so wrapped, may later become vulnerable as a towel tends to become dislodged from the club set as the travel bag is moved about. In extreme cases, one might attempt to secure the clubs, or towel with clubs, by an adhesive strap such as duct tape. Tape wound about the hosel portions of a group of clubs holds them fast together. This practice is undesirable for several reasons, among which includes: it tends to leave a messy residue and soil the finish of the clubs. Additionally, it is inconvenient to pack and travel with a roll of tape for return trips.

While the systems and inventions of the prior art are designed to achieve particular goals and objectives, some of those being no less than remarkable, these inventions have limitations which prevent their use in new ways now possible. These prior art inventions are not used and cannot be used to realize the advantages and objectives of the present invention.

SUMMARY OF THE INVENTION

Comes now, Jeffrey C. Herold with an invention of a travel bag for golf club sets including specialized restraining strap and system for immobilizing golf clubs. It is a primary function of travel bags of the invention to provide a restraint mechanism to prevent golf club heads from appreciably moving about therein. A fundamental difference between travel bags taught here and those of the art can be found when considering its features relating to providing said restraint means.

A golf club travel bag is provided with a means of securing golf clubs contained therein. A strap is integrated with the travel bag in a position near the top of the bag in a looping fashion symmetric about the longitudinal axis of the bag. When a golf club set is placed in the bag, the club hosels, i.e. the portion of the club where the club head connects to the club shaft, is also near the top of the travel bag. In this way, the position of the strap corresponds roughly to the position of the golf club hosels. The strap is preferably affixed to the outer surface of the travel bag. The inner surface of the bag is equipped with a layer of protective material such as foam. The foam layer prevents outside sources of impact from being transmitted to the clubs. It additionally puts pressure on the clubs which tends to hold them together and from banging into one another. The layer of protective material is compressed onto the clubs by applying the strap and fastening it about the bag.

Accordingly, it is a primary object of the invention to provide a golf club travel bag. It is an additional object of the invention to provide a travel bag with a club securing means. It is an object of the invention to prevent damage to clubs stored and packed for travel. These and other objects and aspects of the invention will be readily appreciated in view of the following detailed description of the invention and appended drawing figures.

A better understanding can be had with reference to the detailed description of preferred embodiments. These embodiments represent particular ways to realize the invention and are not inclusive of all ways possible. Therefore, there may exist embodiments that do not deviate from the spirit and scope of this disclosure as set forth by the claims, but do not appear here as specific examples. It will be appreciated that a great plurality of alternate versions are possible.

BRIEF DESCRIPTION OF THE DRAWING FIGURES

The invention will become better understood with regard to the following description, appended claims and drawings where:

PREFERRED EMBODIMENTS OF THE INVENTION

In accordance with each of the preferred embodiments of the invention, there is provided an apparatus for use as a travel bag for golf equipment. It will be appreciated that each of the embodiments described include an apparatus which may be different than the apparatus of another embodiment.

Figure 1:
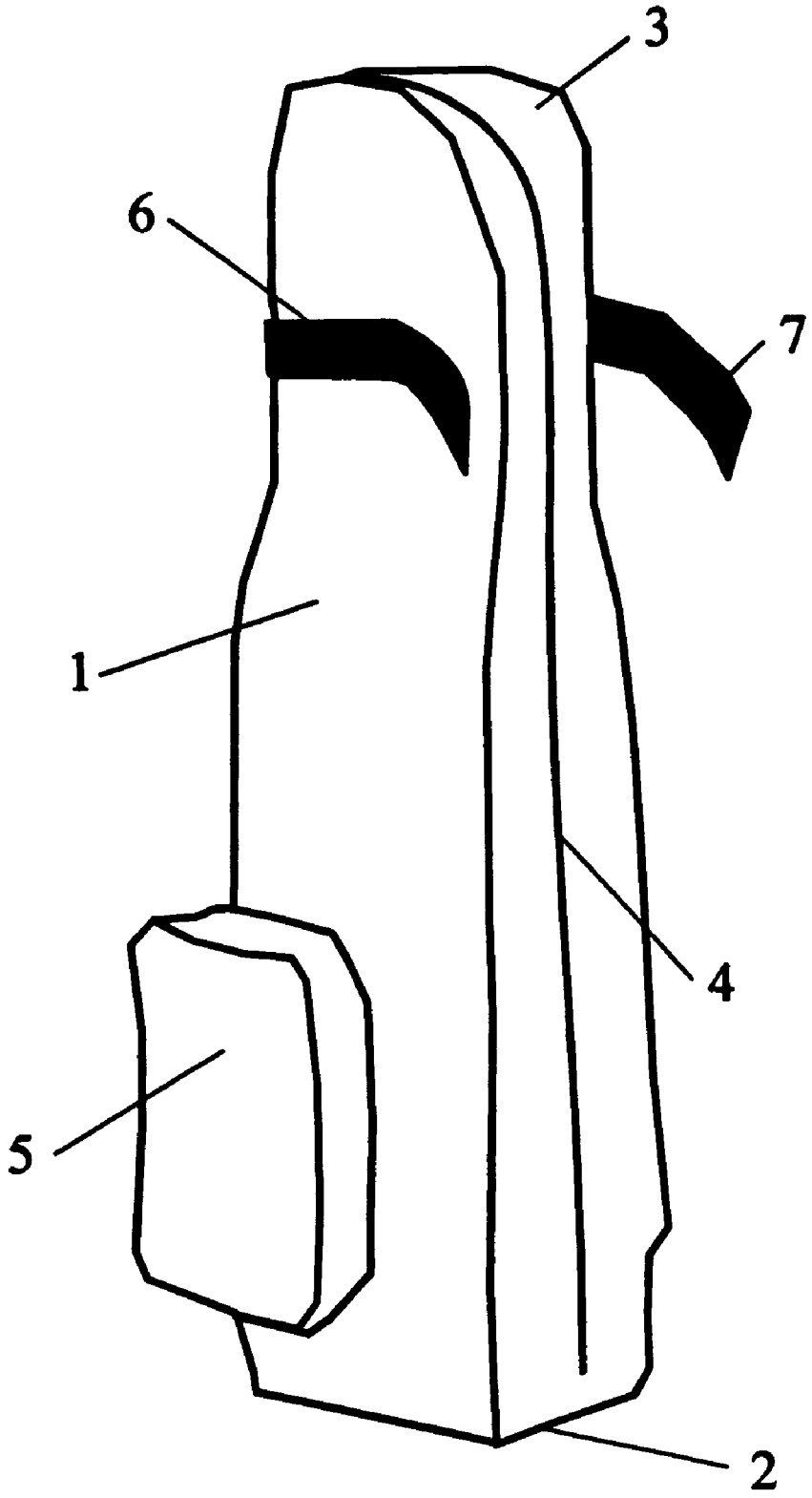
FIG. 1 is a drawing of a golf club travel bag of the invention in perspective view.
Figure 2:
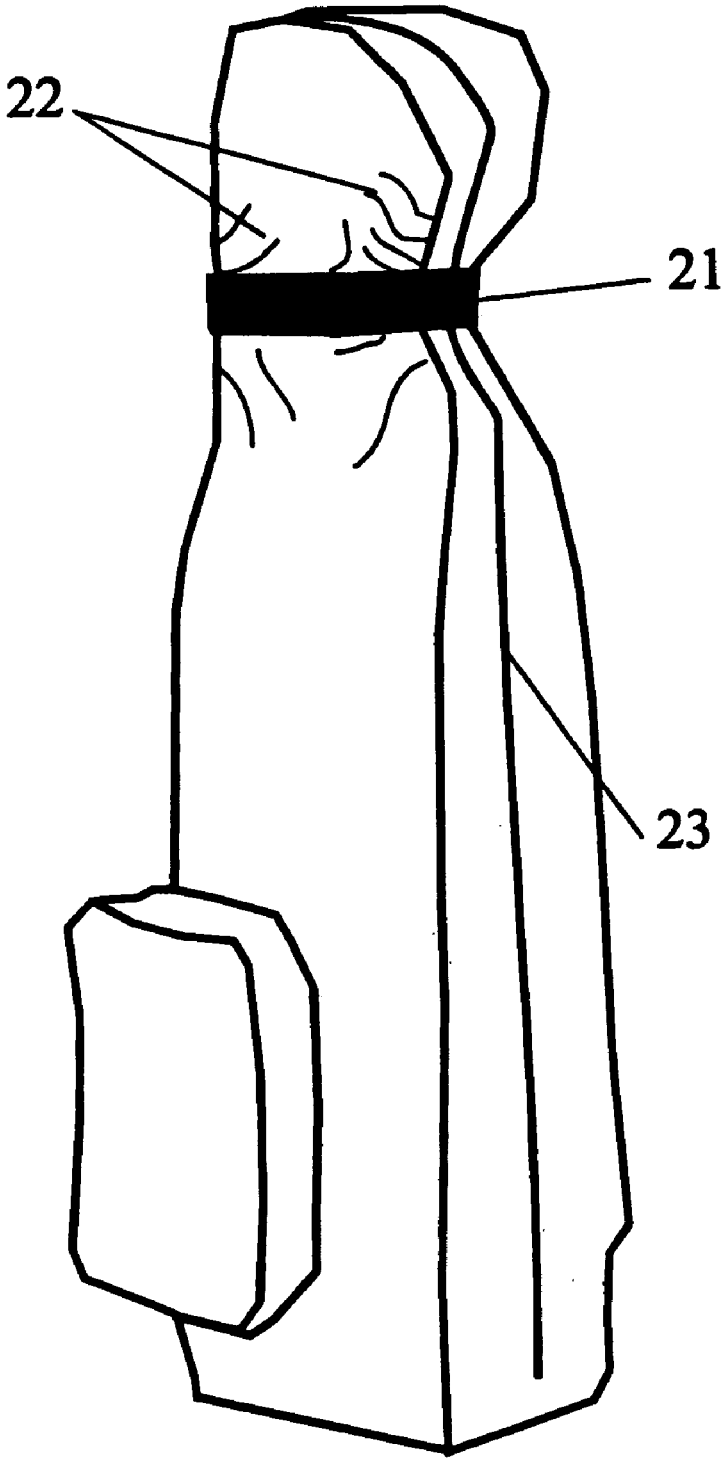
FIG. 2 is a similar drawing showing a fastened strap near the top of the bag.

FIG. 1 shows a travel bag of the invention in a perspective view drawing. The main body portion of the bag 1 is preferably fabricated of strong, flexible material which is resistant to tearing and puncture. The main body portion forms a flexible outer shell in which a golf club set may be placed. Some Nylon materials are well suited for use in luggage manufacture and may be used in connection with this invention. The bag may have a rigid base 2 made of a material such as plastic. A high impact polyurethane material is sometimes preferred as it is inexpensive and easily shaped. The bag has a top portion 3 and an opening along a zipper 4. The bag may include a pocket 5 or alternative accessory holder sewn to its exterior. A strap shown in an unfastened position 6 and 7, may have two ends. Attention is directed to drawing FIG. 2 where a travel bag of the invention is illustrated with a restraint means being fastened. After placing a club set into the bag and closing the zippered opening 23, the ends of the strap may be pulled and fastened together 21 to form a continuous loop about the top portion of the bag. Pressure applied to the strap is maintained by the fastener of the strap. Pressure is transferred to the bag and tends to crumple 22 the flexible material which comprises the main body of the bag.

Figure 3:
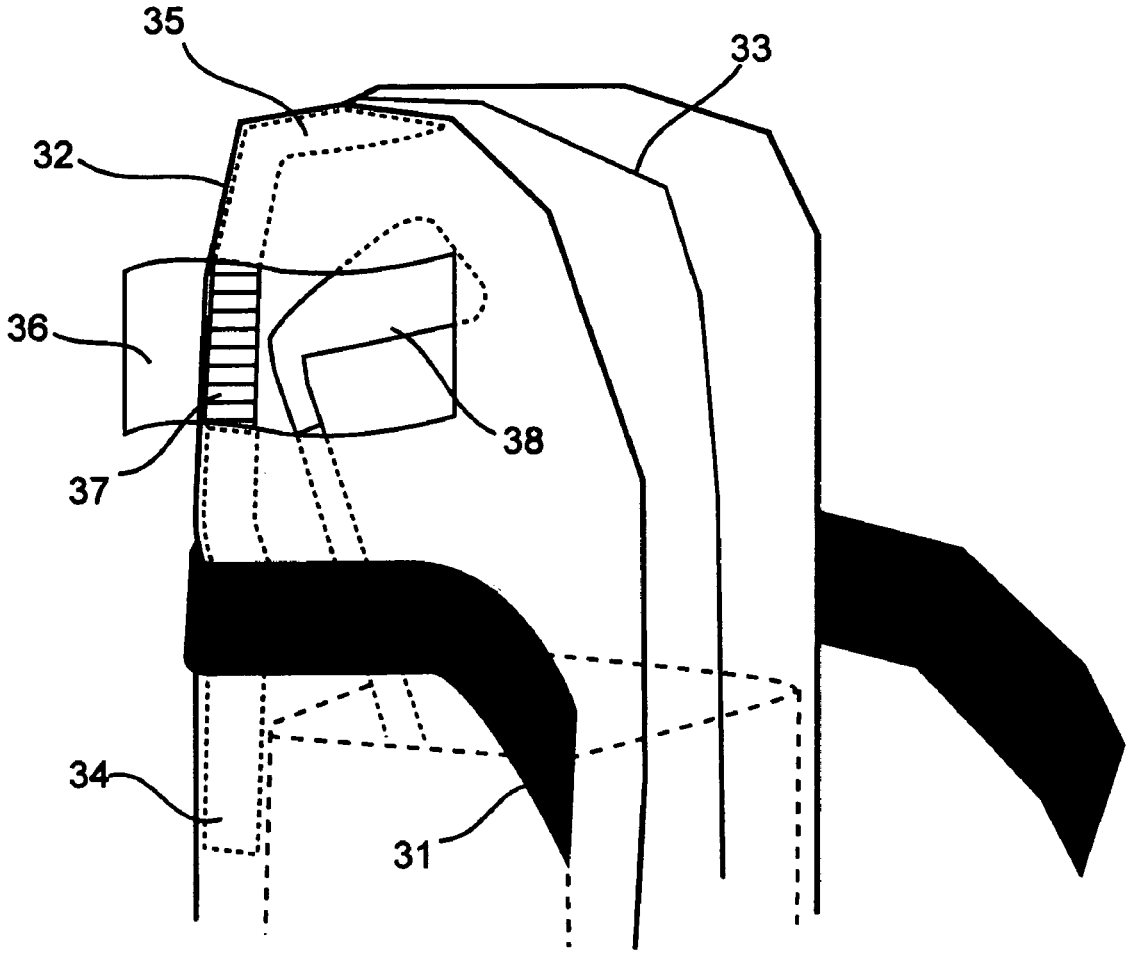
FIG. 3 is close-up view of the top of the bag additionally showing elements stored therein.

A detailed close-up drawing of the top of the bag is shown in FIG. 3. A first end of a strap 31 is shown. The strap may be continuous and wrap around behind the bag as shown in the figure. The strap may fastened over the zipper 33 opening. The bag is preferably made of a thin flexible material such as woven cloth 32 having a thickness of a small fraction of an inch. A protective layer 37 such as a foam pad may be affixed to the interior surface of the bag to form a cushion lining. The protective layer should extend from below the strap at a position indicated by 34 up to the top 35 of the bag where it terminates. The drawing includes a window 36 which shows clearly the contents of the bag. Dotted lines in the figure indicate items in the bag not visible through the window. The protective layer 37 may generally be between ⅛ of and inch and 1 inch in thickness. It may be made of a variety of cushion materials such as foam or neoprene. A golf club head 38 contained in the bag which may come into contact with the protective layer is shielded from any impact forces which may be incident upon the bag from the outside. If a plurality of clubs are stored in the bag, the protective layer tends to push them together under the pressure of the strap and hold them such that they will not bang into each other.

Figure 4:
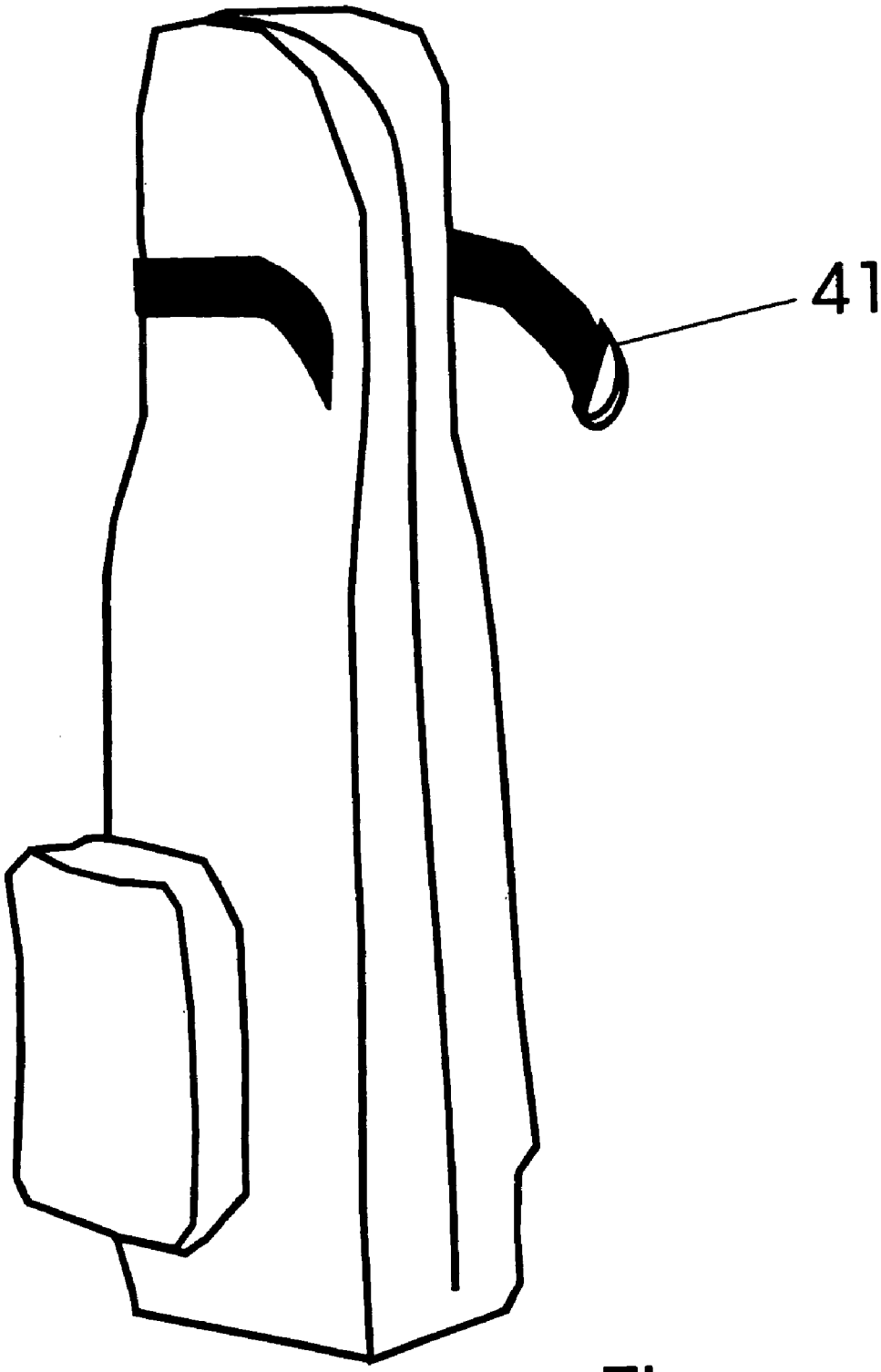
FIG. 4 illustrates an embodiment of a buckle.
Figure 5:
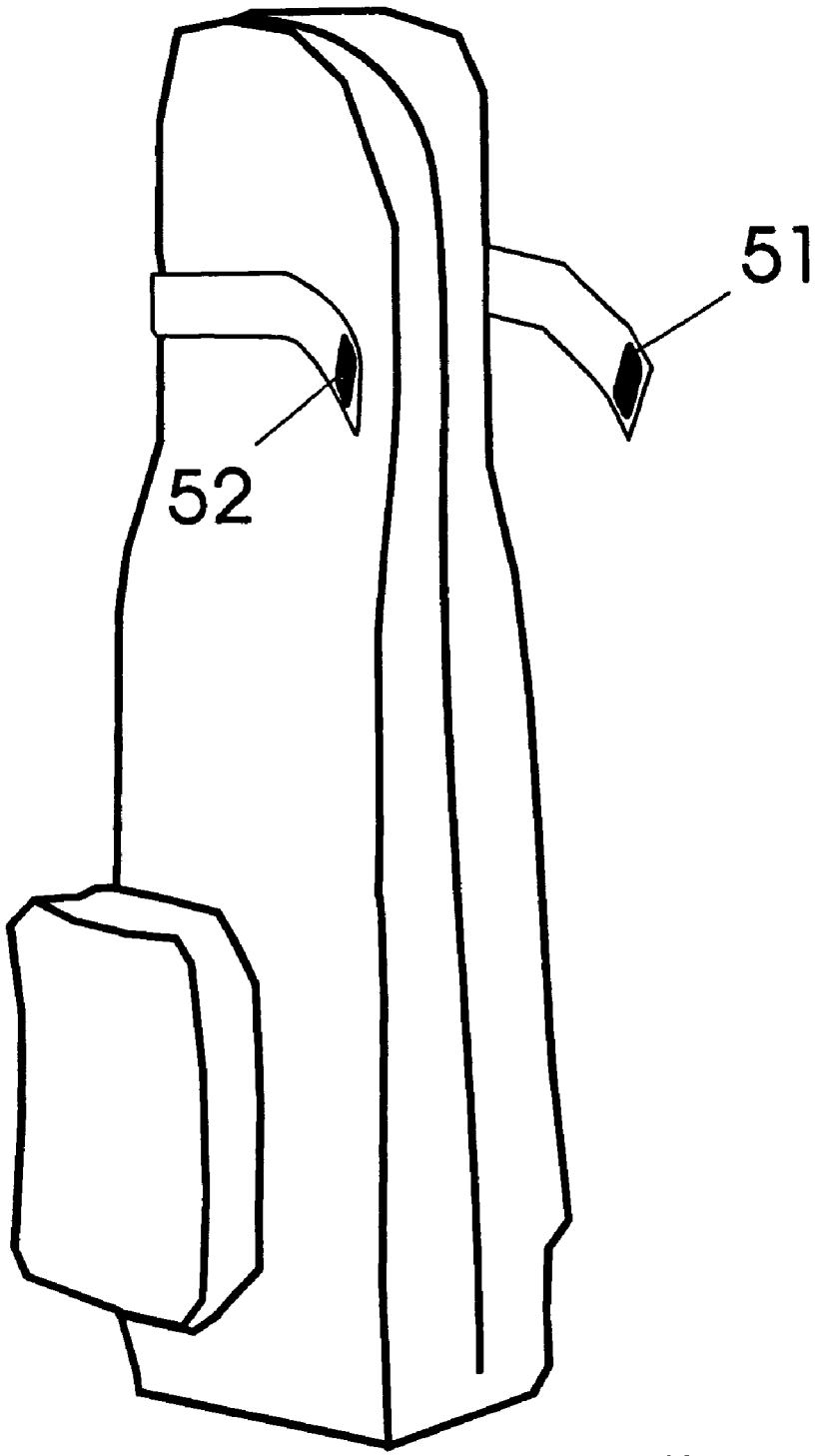
FIG. 5 illustrates an embodiment of a hook and loop fastener with respect to a bag strap.

One will readily appreciate that a great many variations are possible for a strap. FIG. 4 illustrates a buckle 41 which may be used in various embodiments of the invention. FIG. 5 illustrates an alternative embodiment with the use of hook and loop fastener 51 and 52 in use with a bag strap. In yet another embodiment, it is possible that the strap be made of two small portions each sewn to the bag on either side of the zipper. When pulled together and attached, these pieces operate in the same way as a single strap. The material of the bag serves as the connection between the two portions. A single strap may be arranged with a loop and hook fastener element on one side. Such a strap pulled across the bag can be received by a mating loop and hook element affixed to the exterior of the bag. Two ends of a strap may have thereon, mating portions of a buckle device. Alternatively, a strap may incorporate a snap fastener. Similarly, a strap might be made of an elastic material which stretches about the bag. Of these variations, a common link is that a means for causing a force directly radially inward is produced. Accordingly, the invention does not depend on either of the single named variations described here, but instead works very well with any of them.

Although the present invention has been described in considerable detail with clear and concise language and with reference to certain preferred versions thereof including the best mode anticipated by the inventor, other versions are possible. Therefore, the spirit and scope of the appended claims should not be limited by the description of the preferred versions contained therein.

What is claimed is:

1. A golf club travel bag for carrying and protecting golf clubs in a course bag wherein the heads and a portion of the shafts of the golf clubs protrude from the course bag, the travel bag having a restraining feature, the travel bag comprising:

a flexible outer shell made of a flexible material and forming a cavity operable for accommodating the set of golf clubs in a course bag;

a cushion lining, said cushion lining being affixed to an interior surface of a portion of said flexible outer shell where the club heads and protruding shaft portions are located, to form a protective layer around the golf club heads and protruding shaft portions; and, a strap, said strap forming a looping configuration about said flexible outer shell whereby fastening said strap causes compression of said cushion lining onto the golf club heads and protruding shaft portions.

2. The golf club travel bag of claim 1 wherein said travel bag comprises a lower section to surround the course bag and an upper section to surround the heads and the portion of the shafts of the golf clubs which protrude from the course bag.

3. The golf club travel bag of claim 1 wherein said cushion lining is located only in the upper section of said travel bag.

4. The golf club travel bag of claim 2 wherein said strap is located to form a looping configuration about the upper section of said travel bag.

5. The golf club travel bag of claim 2 wherein the strap is attached to the upper section of said travel bag.

6. The golf club travel bag of claim 1 wherein said cushion lining is formed of foam padding which is between ⅛ inch and 1 inch thick.

7. A golf club travel bag for carrying and protecting golf clubs in a course bag wherein the heads and a portion of the shafts of the golf clubs protrude from the course bag, the travel bag having a restraining feature, the travel bag comprising:

a flexible outer shell;

a cushion lining affixed to an interior surface of a portion of said flexible outer shell; and, a strap, said strap forming a looping configuration about said flexible outer shell whereby fastening said strap causes compression of said cushion lining onto the golf club heads and protruding shaft portions.

8. The golf club travel bag of claim 7, said strap comprising two ends operable for being affixed or connected to each other.

9. The golf club travel bag of claim 7, said strap further comprising a buckle fastening means.

10. The golf club travel bag of claim 7, said strap further comprising a hook and loop fastening means.

11. The golf club travel bag of claim 7, said strap further comprising two strap portions sewn to either side of a zippered opening on said travel bag.

* * * * *